US009677273B2

(12) United States Patent
Abbas et al.

(10) Patent No.: US 9,677,273 B2
(45) Date of Patent: Jun. 13, 2017

(54) CONCRETE-FILLED STEEL TUBULAR COLUMN FOR HIGH LOAD CARRYING CAPACITY AND FIRE RESISTANCE

(71) Applicant: King Saud University, Riyadh (SA)

(72) Inventors: Husain Abbas, Riyadh (SA); Yousef A Al-Salloum, Riyadh (SA); Tarek H Almusallam, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 14/554,449

(22) Filed: Nov. 26, 2014

(65) Prior Publication Data

US 2016/0145862 A1 May 26, 2016

(51) Int. Cl.

| | |
|---|---|
| ***E04C 3/34*** | (2006.01) |
| ***E04C 3/32*** | (2006.01) |
| *E04B 1/94* | (2006.01) |

(52) U.S. Cl.

CPC ..... *E04C 3/34* (2013.01); *E04B 1/943* (2013.01); *E04C 3/32* (2013.01); *E04B 1/946* (2013.01)

(58) Field of Classification Search

CPC ..... E02D 27/42; E02D 27/32; E02D 27/00; E02D 27/12; E02D 37/00; E02D 5/04;

(Continued)

(56) References Cited

U.S. PATENT DOCUMENTS 3,145,811 A * 8/1964 Strehan ..... E04B 1/943 52/1

3,616,583 A * 11/1971 Weineck et al. ..... 52/168

(Continued)

*Primary Examiner* — Joshua J Michener
*Assistant Examiner* — Matthew Gitlin
(74) *Attorney, Agent, or Firm* — Hauptman Ham, LLP

(57) ABSTRACT

A concrete-filled steel tubular column for high load capacity, usually required in tall buildings, includes an outer longitudinally extending generally vertical tubular shell and an inner longitudinally extending perforated tubular steel shell disposed within said outer longitudinally extending vertical tubular shell and coaxial therewith. Further, a plurality of relatively small diameter vertically extending perforated tubular steel members are disposed around said inner longitudinally extending tubular shell between said outer longitudinally extending tubular steel shell and said inner longitudinally extending steel shell with axes parallel to said coaxial axes. The concrete-filled steel column wherein said inner steel shell is centrally disposed within the outer longitudinally extending vertical tubular steel shell and wherein the volume between the outer steel shell and the inner shell is filled with high strength concrete. The perforated inner shell and members have a plurality of meltable polymer plugs or caps on perforations to prevent plastic cement from flowing into or closing the openings during concreting. In the event of fire the plastic or polymer plugs or caps melt and allow gases and smoke to flow into the pipes and up through the inner member and out therefrom at the top of the column The inner vertical tubular shell and members may be subsequently used for injecting grout through the perforations (which get opened during fire by melting of polymer caps) for strengthening the post fire damaged concrete).

1 Claim, 5 Drawing Sheets

(58) Field of Classification Search
CPC ..... E04C 3/30; E04C 2003/0447; E04C 3/36; E04C 3/34; E04C 2003/0439; E04C 3/32; E04B 1/92; E04B 1/945; E04B 1/946
See application file for complete search history.

(56) References Cited

U.S. PATENT DOCUMENTS

| | | | | | |
|---|---|---|---|---|---|
| 4,234,270 | A | * | 11/1980 | Gjerde et al. | 405/202 |
| 4,722,156 | A | * | 2/1988 | Sato | 52/98 |
| 4,779,395 | A | | 10/1988 | Schleich et al. | |
| 5,012,622 | A | * | 5/1991 | Sato et al. | 52/834 |
| 5,174,080 | A | * | 12/1992 | Yoshimura et al. | 52/252 |
| 5,799,924 | A | * | 9/1998 | Slocum et al. | 248/636 |
| 6,409,433 | B1 | * | 6/2002 | Hubbell et al. | 405/250 |
| 8,484,915 | B1 | | 7/2013 | Abbas et al. | |
| 2004/0250503 | A1 | * | 12/2004 | Bigelow | 52/729.2 |
| 2005/0000186 | A1 | * | 1/2005 | Van Erp | 52/745.19 |
| 2005/0050837 | A1 | * | 3/2005 | Wang | 52/721.3 |
| 2005/0229532 | A1 | * | 10/2005 | Teng | 52/736.3 |
| 2008/0196341 | A1 | * | 8/2008 | Kang et al. | 52/292 |
| 2008/0202038 | A1 | * | 8/2008 | Orava | 52/1 |
| 2009/0084061 | A1 | * | 4/2009 | Pan | 52/741.3 |
| 2009/0120025 | A1 | * | 5/2009 | Sezen et al. | 52/340 |

* cited by examiner

CONCRETE-FILLED STEEL TUBULAR COLUMN FOR HIGH LOAD CARRYING CAPACITY AND FIRE RESISTANCE

FIELD OF THE INVENTION

This invention relates to concrete-filled steel columns for high load carrying capacity and fire resistance, usually required in tall buildings. More particularly the invention relates to concrete-filled steel tubular columns having a plurality of vertical tubular members for venting smoke and noxious gases from a fire and dissipating heat of hydration of concrete. Moreover the column can be easily and effectively strengthened after damage during fire without shape change.

BACKGROUND OF THE INVENTION

The use of concrete-filled steel tubular (CFST) columns has increased in recent decades due to their excellent structural performance which takes advantage of the combined effect of steel and concrete working together. The steel tube provides confinement to the concrete core resulting in increased compressive strength whereas the concrete core restricts inward deformation of the steel tube thus enhancing local buckling resistance of steel tubes. In addition to these advantages, the steel tubes surrounding the concrete columns eliminates permanent formwork which reduces the construction time and costs. Moreover, CFST columns possess better fire resistance as compared to steel columns The fire risk in high-rise buildings is significantly higher than a lower-rise building because of the potential for more fire locations and greater consequences of the fire itself (e.g. stack effect) and to a greater number of occupants. However, the fires in high-rise buildings generate large quantities of smoke that can spread vertically or horizontally through the building even if the fire is contained to only one room or unit. The smoke emitting from burning polypropylene fibers usually embedded in high strength concrete adds more toxicity to the smoke which is responsible for many of the fatalities in such incidents. Thus, there is higher potential risk to life from fire in high-rise buildings which demands greater fire safety in these buildings where CFST columns are commonly used for carrying heavy loads.

There are a number of approaches for the construction of such columns to overcome the problem with such construction as for example in the escape of smoke and gases during exposure to fire especially when the columns are massive. The problem gets aggravated with the use of high-strength concrete because of the reduced porosity thus providing fewer escape routes for gases during fire exposure. The mixing of polypropylene fibers in the high-strength concrete of reinforced concrete members helps to provide passages by the melting of fibers during fire for the escape of gases from inside a concrete mass. But, the mixing of polypropylene fibers in concrete of CFST columns will not be that effective because of the requirement of a large number of vents required in the steel tube which is not structurally favorable. The exposure of such columns to fire may lead to more serious consequences in the case of insufficient vents. Therefore, most of the available studies use a plurality of vents in the outer steel column for the escape of gases.

A U.S. Pat. No. 8,484,915 of Abbas et al. entitled "System for Improving Fire Endurance of Concrete-Filled Steel Tubular Columns" is assigned to the same assignee as the present invention. As disclosed therein, a concrete filled tubular steel column includes a longitudinally extending outer vertical tubular steel shell and an inner perforated tubular steel shell disposed at the center of the outer steel shell to be coaxial therewith. A plurality of spaced vertically steel plates extend from the inner steel shell towards but not abutting the outer steel shell. In addition, a plurality of horizontally disposed perforated pipes extend outwardly from the inner member. All perforated inner tubular steel shell and pipes have a plurality of meltable polymer plugs or caps to prevent plastic cement from flowing into or closing the openings. In the event of fire, the plastic or polymer plugs or caps melt and allow gases and smoke to flow into the perforated pipes and up through the inner member and out therefrom to the top of the column It is presently believed that there is a present need and a potential commercial market for an improved concrete-filled steel tubular column for high load carrying capacity and fire resistance. There should be a need and a potential commercial market for such products that dissipate smoke and toxic gases at the top of the column, eliminate to a large degree exit vents in the steel tubular column and to a larger degree reduce the smoke and toxic gases from areas adjacent to inhabited floors as well as reducing the costs while maintaining the load carrying capacity.

BRIEF SUMMARY OF THE INVENTION

In essence, the present invention contemplates a concrete-filled steel tubular column for high load carrying capacity that may be relatively massive and/or more effective in dissipating smoke and toxic gases near the top of the column and away from human inhabitants in the upper floors of a building. The column comprises and/or consists of an outer longitudinally extending generally vertical tubular shell and an inner longitudinally extending perforated steel tubular shell disposed within said outer longitudinally extending vertical tubular shell and coaxially therewith. In addition, a plurality of relatively small diameter vertically extending perforated tubular steel members are disposed around the inner longitudinally extending tubular shell between the outer longitudinally extending tubular shell and the inner longitudinally extending steel shell with axes parallel to the coaxial axis. All perforated inner tubular steel shells and members have a plurality of meltable polymer plugs or caps to prevent plastic cement from flowing into or closing the openings. In the event of fire, the plastic or polymer plugs or caps melt and allow gases and smoke to flow into the inner perforated pipes and out therefrom to the top of the column The invention will now be described in connection with the accompanying drawings wherein like elements are designated with like numbers.

DETAILED DESCRIPTION OF THE PREFERRED EMBODIMENTS OF THE INVENTION

Figure 1:
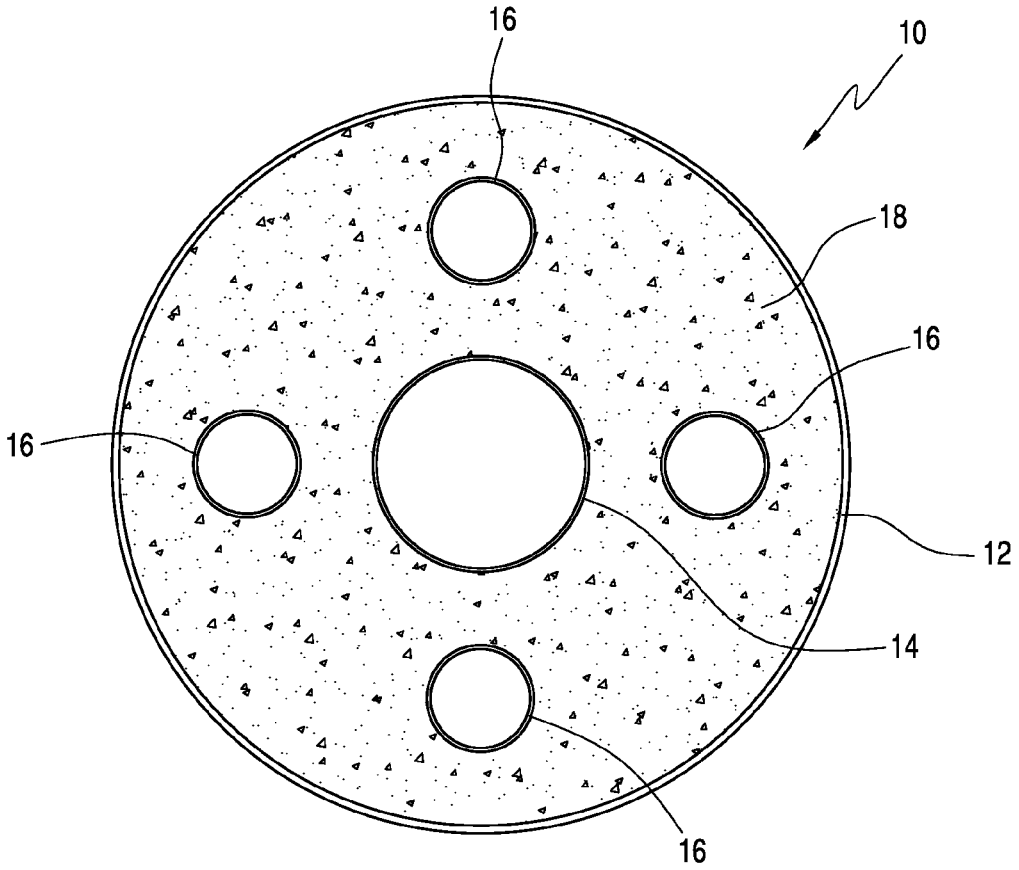
FIG. 1 is a cross sectional view of a circular shaped concrete-filled tubular steel column in accordance with a first embodiment of the invention.

As illustrated in FIG. 1 a generally vertical concrete-filled steel tubular column 10 includes an outer steel shell 12 having a generally circular cross section and a generally circular inner perforated steel shell 14 dispersed in the center of the outer steel shell 12.

As shown, the steel tubular column 10 also includes a plurality of relatively small diameter vertically extending perforated tubular steel members 16 disposed around the inner longitudinally extending perforated tubular steel shell 14 between the outer tubular shell 12 and inner tubular shell 14. As presently contemplated, the outer steel shell 12 has a minimum diameter of about 500 mm while the inner shell will have a minimum diameter of about 150 mm as designed for structural consideration and loads. By contrast, the longitudinally extending steel tubular member 16 will have a minimum diameter of about 150 mm as designed for structural consideration and loads. The perforations of the inner longitudinally extending perforated tubular steel shell 14 and small diameter vertically extending perforated tubular steel members 16 are all closed with a plurality of water resistant polymer caps for preventing the escape of water or mortar through the openings when the cement is in the plastic state. Further, the plastic caps are melted during a fire thus providing passage for the escape of gases through the inner vertical tubular members 14 and 16 to the top.

It is also contemplated that the height of the column 10 will extend for full height of a building i.e. up to the roof top so that smoke and gases escape through the roof top.

Figure 2:
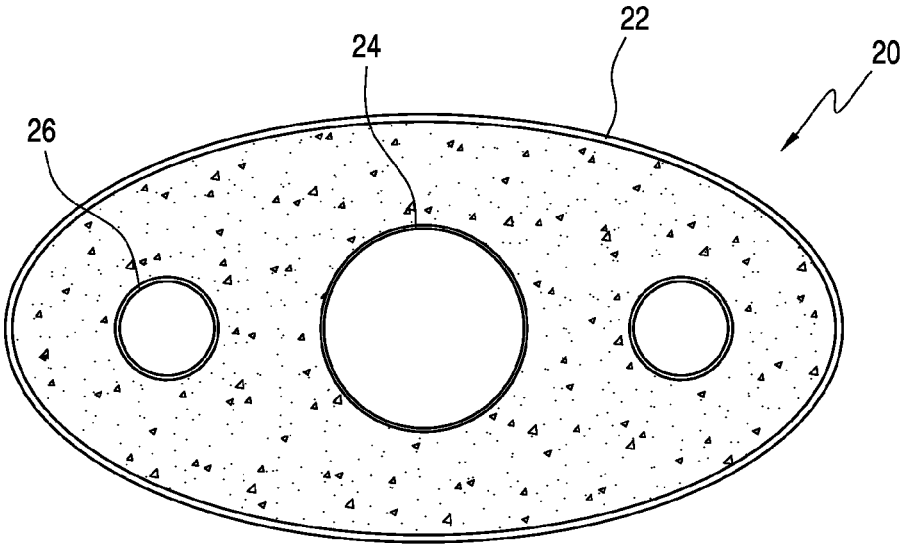
FIG. 2 is a cross sectional view of an elliptically shaped concrete-filled tubular steel column in accordance with a second embodiment of the invention.

Referring now to FIG. 2, a generally vertical concrete-filled steel tubular shell 20 has a generally elliptical cross sectional shape and includes an outer shell 22 and an inner perforated shell 24 having a generally circular shape as well as two perforated tubular steel members 26. As with FIG. 1, the inner shell may be positioned and maintained with respect to the outer shell 22. Further, the second embodiment is shown with two upwardly extending perforated tubular steel members 26. The perforations of the inner longitudinally extending perforated tubular steel shell 24 and small diameter vertically extending perforated tubular steel members 26 are all closed with a plurality of water resistant polymer caps for preventing the escape of water or mortar through the openings when the cement is in the plastic state. Further, the plastic caps are melted during a fire thus providing passage for the escape of gases through the inner vertical tubular members 24 and 26 to the top.

As shown in FIGS. 1 and 2, the vertically extending tubular steel members 16 and 26 have diameters that are preferably smaller than the diameter of the inner steel shell 14 (FIG. 1) and 24 (FIG. 2). As an example, the diameter of the vertically extending inner steel shell members 26 (FIG. 2) and 16 (FIG. 1) are a minimum of 100 mm as designed for structural consideration and loads. As shown in FIG. 2, there are only two vertically extending tubular steel members 26 that are perforated as shown in FIG. 3. The vertically extending tubular members 16 are likewise perforated in a similar manner as shown in FIG. 3. In addition, the tubular steel shell 24 (FIG. 2) and inner tubular steel shell 14 (FIG. 1) are perforated as shown in FIG. 3. The perforations are all closed with a plurality of water resistant polymer caps for preventing the escape of water or mortar through the openings when the cement is in the plastic state. Further, the plastic caps are melted during a fire thus providing passage for the escape of gases through the inner vertical tubular members 14 and 16 (FIG. 1) 24 and 26 (FIG. 2) to the top.

Figure 3A:
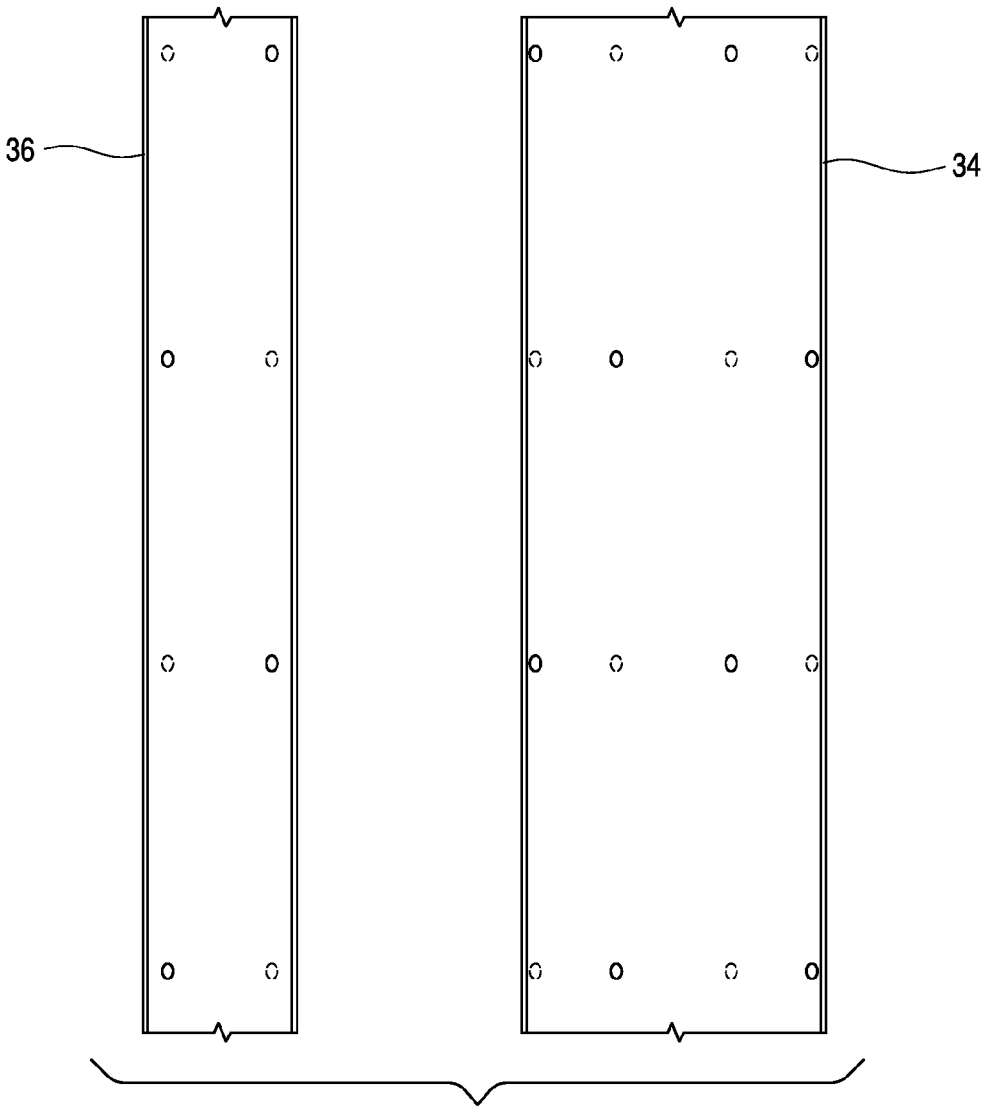
FIG. 3A is a side elevational view illustrating the difference between the size of an inner central perforated steel shell and a number of relatively small diameter tubular steel members.
Figure 3B:
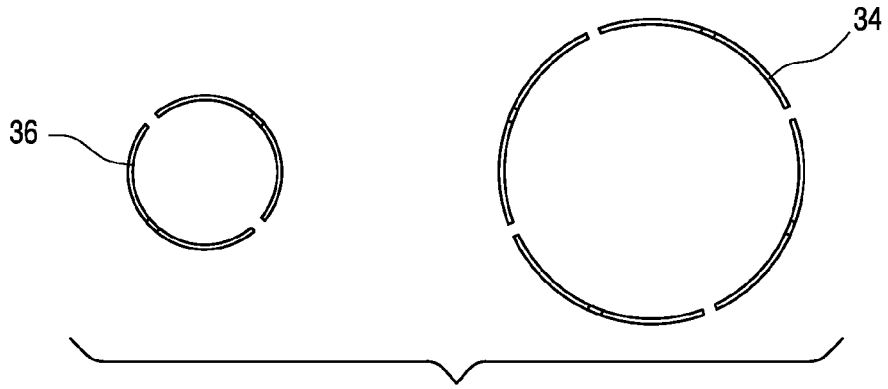
FIG. 3B is a comparative cross sectional view illustrating the difference in diameter between an inner central perforated steel shell and one of a plurality of relatively small diameter tubular steel members.

With respect to FIGS. 3A and 3B a comparison of a side elevational view of an inner vertically extending tubular steel shell 34 and an inner small diameter vertically extending steel member 36 are shown. Similarly, a similar comparison of the cross sectional view are shown in FIG. 3B.

Figure 4:
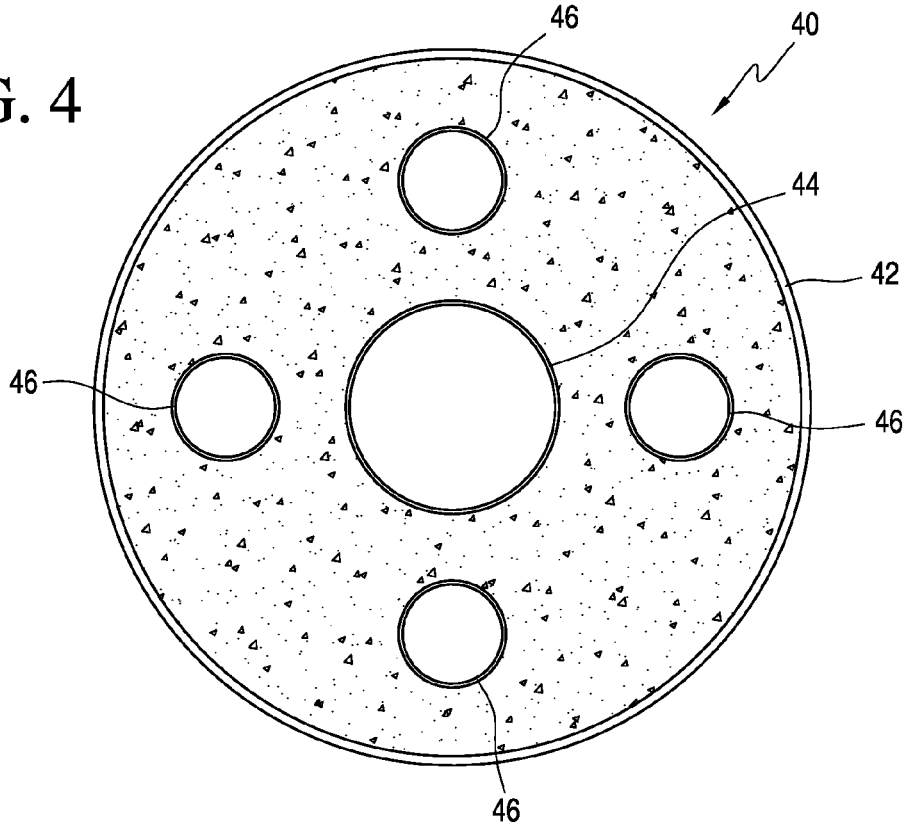
FIG. 4 is a cross sectional view of the first embodiment of the invention as used for injecting chilled water for cooling the column during a fire.

Referring now to FIG. 4, a vertically extending concrete-filled steel tubular column 40 is defined by a circular outer steel shell 42 and further includes a circular inner steel shell 44. In addition, four vertically extending tubular steel members 46 extend from the bottom of column 40 to its top and are positioned with respect to the inner tubular shell 44. As illustrated in FIG. 4, chilled water may be pumped upwardly or downwardly through the inner tubular steel shell 44 and tubular steel members 46 for the dissipation of the heat of hydration of concrete during its early age and thus avoiding the development of thermal stresses in concrete.

Figure 5:
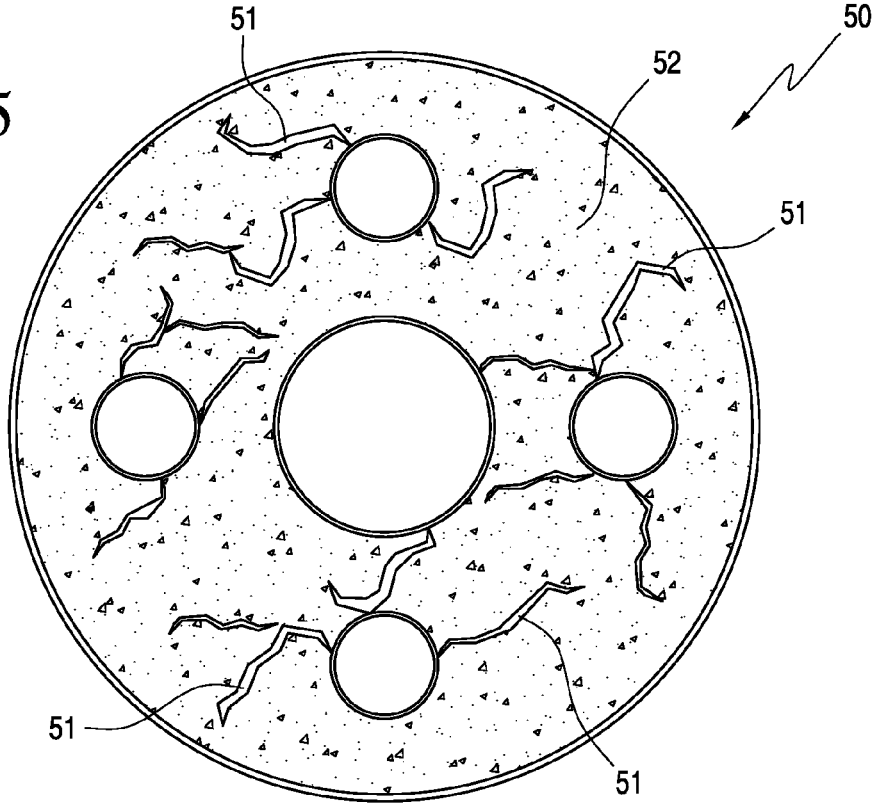
FIG. 5 is a cross sectional view illustrating the dissipation of smoke and toxic gases through cracks developed during an intense fire.

For comparison, FIG. 5 illustrates a direction of the smoke and gas from the lower portion of a building upwardly to the top of the building and out of the building. As illustrated in FIG. 5, a series of cracks 51 have been formed in the concrete core 52 due to the heat generated by a fire and/or possibly earlier by the heat of hydration.

Figure 6:
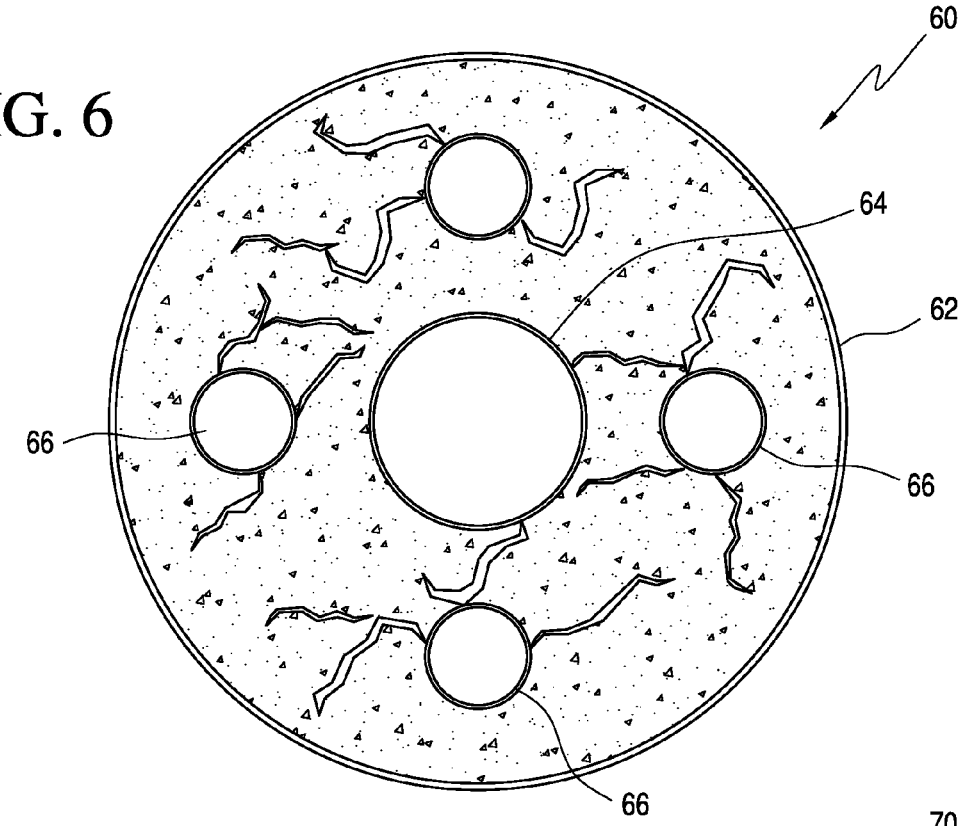
FIG. 6 is a cross sectional view of a first embodiment of the invention illustrating the addition of grout in a repair of fire damage.

FIG. 6 illustrates a method for increasing the strength of a fire damaged column 60 wherein the column includes an outer tubular steel shell 62 and inner steel shell 64 and four vertically extending steel tubular members 66 that extend upward up to the roof. As illustrated, the concrete of column 60 contains a number of cracks as a result of fire damage and can be repaired to a degree by filling the inner upwardly extending tubular shell 64 and upwardly extending steel tubular members 66 as well as cracks that are connected to the inner steel tubular shell 64 and upwardly extending steel tubular members 66 with grout pumped through the perforated members 64 and 66 whose perforations have opened up during fire exposure by the melting of polymer caps.

Figure 7:
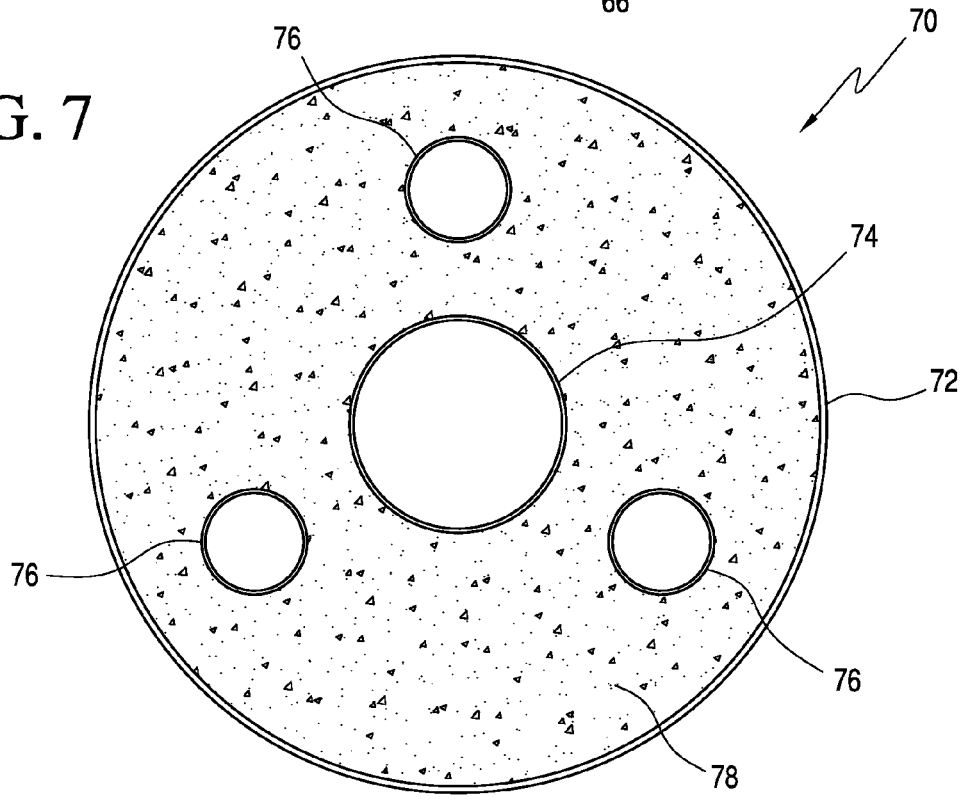
FIG. 7 is a cross sectional view of a third embodiment of the invention.

A further embodiment of the invention is illustrated in FIG. 7, wherein a concrete-filled tubular steel column 70 includes an upwardly extending tubular steel shell 72, an inner upwardly extending tubular steel shell 74 and three upwardly extending tubular steel members 76. As with the other embodiments, the area 78 or volume between the outer and inner shells is filled with cement concrete.

Figure 8:
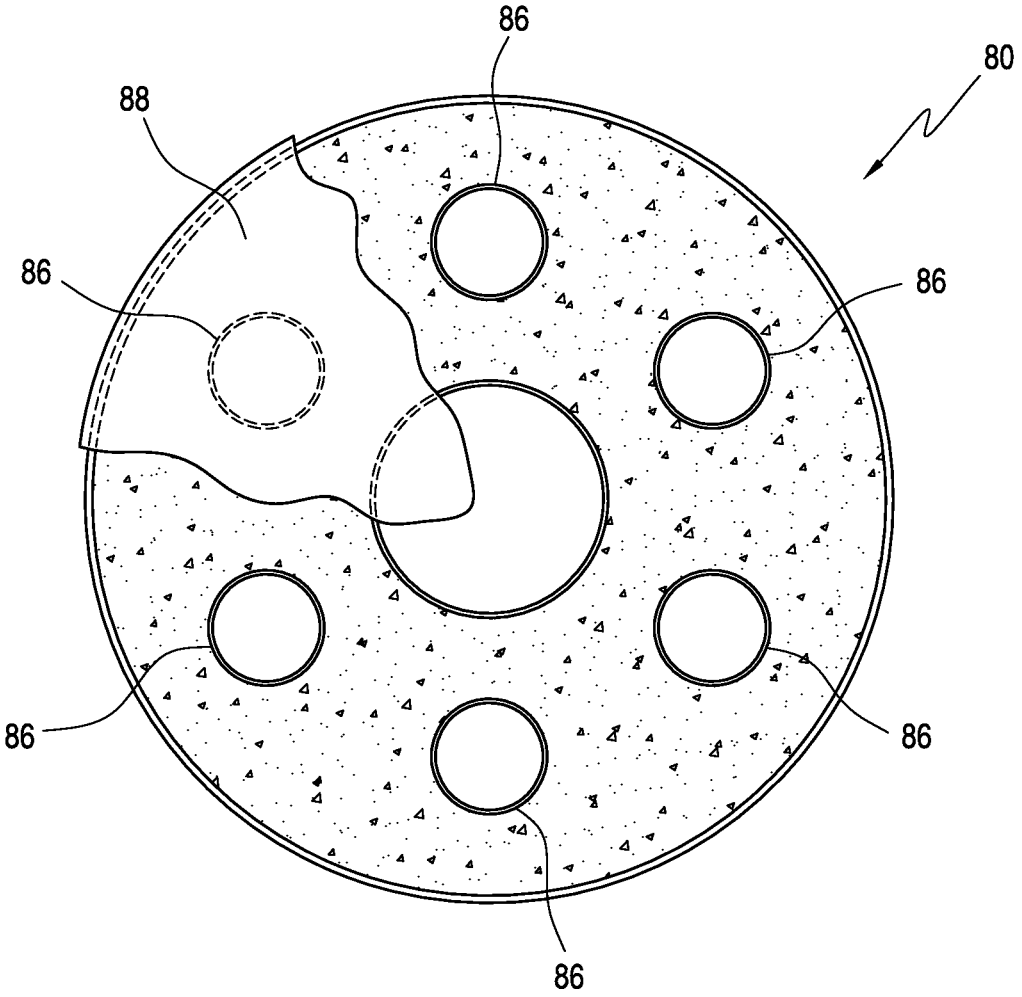
FIG. 8 is a cross sectional view of a fourth embodiment of the invention.

A still further embodiment of the invention, as illustrated in FIG. 8, is generally similar to the earlier embodiments except that in this embodiment a column 80 includes six upwardly extending tubular steel members 86 and a cover 88 that blows off due to escape of gases during fire exposure.

While the invention has been described in connection with its preferred embodiments, it should be recognized and understood that changes and modifications may be made therein without departing from the scope of the appended claims.

What is claimed is:

1. A concrete-filled steel column for high load carrying capacity consisting of:

an outer longitudinally extending generally vertical tubular shell and an inner longitudinally extending perforated steel tubular shell disposed within said outer longitudinally extending vertical tubular shell and coaxial therewith;

four inner vertically extending perforated tubular steel members disposed around said inner longitudinally extending tubular steel shell between said outer longitudinally extending tubular steel shell and said inner longitudinally extending steel shell with axes parallel to said coaxial axes and wherein the diameters of said tubular steel members are equal to or smaller than the diameter of said inner longitudinally perforated steel tubular shell;

a mass of cement filling said outer longitudinally extending generally vertical tubular shell and between said inner longitudinally extending perforated steel tubular shell and said outer longitudinally tubular shell;

a plurality of polymer caps for closing said perforations in said inner perforated tubular steel members and wherein said polymer caps are meltable in the event of an external fire to allow gases generated thereby to exit the column through the inner tubular members and out of the top of the column; and in which said inner longitudinally extending generally vertical steel shell has a circular cross section; and in which said circular cross section has a diameter of between about 300 mms to 1200 mms;

in which said outer longitudinally extending generally vertical tubular steel shell defines a circular cross sectional shape with a minimum diameter of about 500 mms and the inner shell having a minimum diameter of about 150 mm and each of said longitudinally extending steel tubular members each having a maximum diameter of about 150 mm; and in which said mass of concrete is mixed with plastic fibers; and, in which said inner longitudinally extending steel tubular shell includes a plurality of perforations therein for release of smoke and gases, emanating from the heating of concrete, through the inner steel shell and members to the outside at the top of said column; and, which includes a cover and in which said inner steel shell and said steel members are covered at the top of said column such that the cover blows off due to the escape of gases during fire exposure; and, in which the inner vertical tubular shell and members may be subsequently used for injecting grout through the perforations which get opened during fire by melting of polymer caps for strengthening the post fire damaged concrete.

* * * * *